United States Patent [19]

Oaten

[11] 4,278,020

[45] Jul. 14, 1981

[54] PRINT WIRE ACTUATOR BLOCK ASSEMBLY FOR PRINTERS

[75] Inventor: Albert W. Oaten, Boca Raton, Fla.

[73] Assignee: International Business Machines Corporation, Armonk, N.Y.

[21] Appl. No.: 86,483

[22] Filed: Oct. 19, 1979

[51] Int. Cl.[3] ..... B41J 3/10

[52] U.S. Cl. ..... 101/93.05; 400/124

[58] Field of Search ..... 400/124; 101/93.04, 101/93.05

[56] References Cited

U.S. PATENT DOCUMENTS

| | | | |
|---|---|---|---|
| 3,889,793 | 6/1975 | Cattaneo | 400/124 |
| 3,904,011 | 9/1975 | Matschke | 101/93.05 X |
| 3,907,092 | 9/1975 | Kwan et al. | 400/124 |
| 3,929,214 | 12/1975 | Hebert | 400/124 |
| 3,966,035 | 6/1976 | Erickson | 400/124 |
| 3,967,714 | 6/1976 | Potma et al. | 101/93.05 X |
| 3,976,180 | 8/1976 | Jorigny et al. | 400/124 |
| 3,987,883 | 10/1976 | Darwin et al. | 400/124 |
| 4,167,343 | 9/1979 | Golobay | 400/124 |

FOREIGN PATENT DOCUMENTS

| | | | |
|---|---|---|---|
| 52-12024 | 1/1977 | Japan | 400/124 |
| 52-5250 | 2/1977 | Japan | 400/124 |

OTHER PUBLICATIONS

IBM Tech. Disc. Bulletin, by J. E. Lisinski, vol. 21, No. 5, Oct. 1978, p. 1772.

IBM Tech. Disc. Bulletin, by R. W. Kulterman, et al., vol. 21, No. 1, Jun. 1978, p. 15.

IBM Tech. Disc. Bulletin, by J. E. Lisinski, vol. 21, No. 1, Jun. 1978, pp. 16–17.

*Primary Examiner*—Paul T. Sewell

*Attorney, Agent, or Firm*—D. Kendall Cooper

[57] ABSTRACT

A print wire actuator block assembly is described that accommodates a plurality of print wire actuators and print wires, the print wire actuators and print wires being arranged in two rows, the entire assembly forming a compact structure. The print wire actuators and print wires in the two rows are angled inwardly toward one another to form a relatively flat serrated pattern at the print line with precise registration of the print wires.

3 Claims, 29 Drawing Figures

PRINT WIRE ACTUATOR BLOCK ASSEMBLY FOR PRINTERS

BACKGROUND OF THE INVENTION

The invention relates to print wire mounting assemblies but is particularly useful in connection with wire matrix printers having multiple print heads and a plurality of print wires.

Conventional wire matrix printing technology has ordinarily involved relatively few print wire actuators and print wires are assembled in structural configurations for printing of dots in straight lines, either horizontally or vertically. Frequently, while the end result, that is, the actual printing of the dots is relatively simple, the structural arrangements result in close mounting of the print wire actuators and print wires and the provision of integrated structures that are difficult to service.

SUMMARY OF THE INVENTION

In accordance with the present invention, a print wire actuator block assembly is provided for a high speed matrix printer to accommodate a large number of print wire actuators and print wires along a print line, the actuators and print wires being arranged in a manner analogous to a sawtooth or serrated pattern. The assembly is structured in such a manner that any individual print wire or a number of print wires can be readily accessed and removed for servicing without disturbing adjacent print wire actuators and print wires. Provision is also made to arrange the print wires substantially in two rows to achieve a more compact structure, the two rows of print wire actuators being angled inwardly with respect to one another in order to establish a closer proximate relationship at the print line with precise registration thereby achieved for accurate printing of dots making up characters to be printed.

CROSS-REFERENCE TO RELATED PATENT APPLICATIONS

The present patent application is one of a group of copending patent applications which describe the same overall printer subsystem configuration but which individually claim different inventive concepts embodied in such overall printer subsystem configuration. These related patent applications were filed on the same date, namely Oct. 19, 1979, and are as follows:

(1) Application Ser. No. 086,484 entitled "Printer Subsystem with Microprocessor Control", the inventors being Messrs. William W. Boynton et al;

(2) Application Ser. No. 086,494 entitled "Partial Line Turnaround for Printers", the inventors being Messrs. Gregory N. Baker et al;

(3) Application Ser. No. 086,384 entitled "Font Selection and Compression for Printer Subsystem", the inventor being Mr. Lee T. Zimmerman;

(4) Application Ser. No. 086,490 entitled "Automatic Print Inhibit in Margins for Printer Subsystem", the inventors being Messrs. Willard B. Greene et al;

(5) Application Ser. No. 086,491 entitled "Detection of Multiple Emitter Changes in A Printer Subsystem", the inventors beings Messrs. Barry R. Cavill et al;

(6) Application Ser. No. 086,492 entitled "Print Head Image Generator for Printer Subsystem", the inventors being Messrs. Abelardo D. Blanco et al; and (7) Application Ser. No. 086,568 entitled "Ribbon Shield for Printer", the inventor being Mr. Donald K. Rex;

For a better understanding of the present invention, together with other and further advantages and features thereof, reference is made to the description taken in connection with the accompanying drawings, the scope of the invention being pointed out in the appended claims.

BRIEF DESCRIPTION OF THE DRAWINGS

Referring to the drawings.

Figure 28:
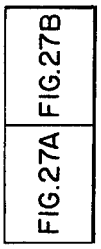
Figure 29:
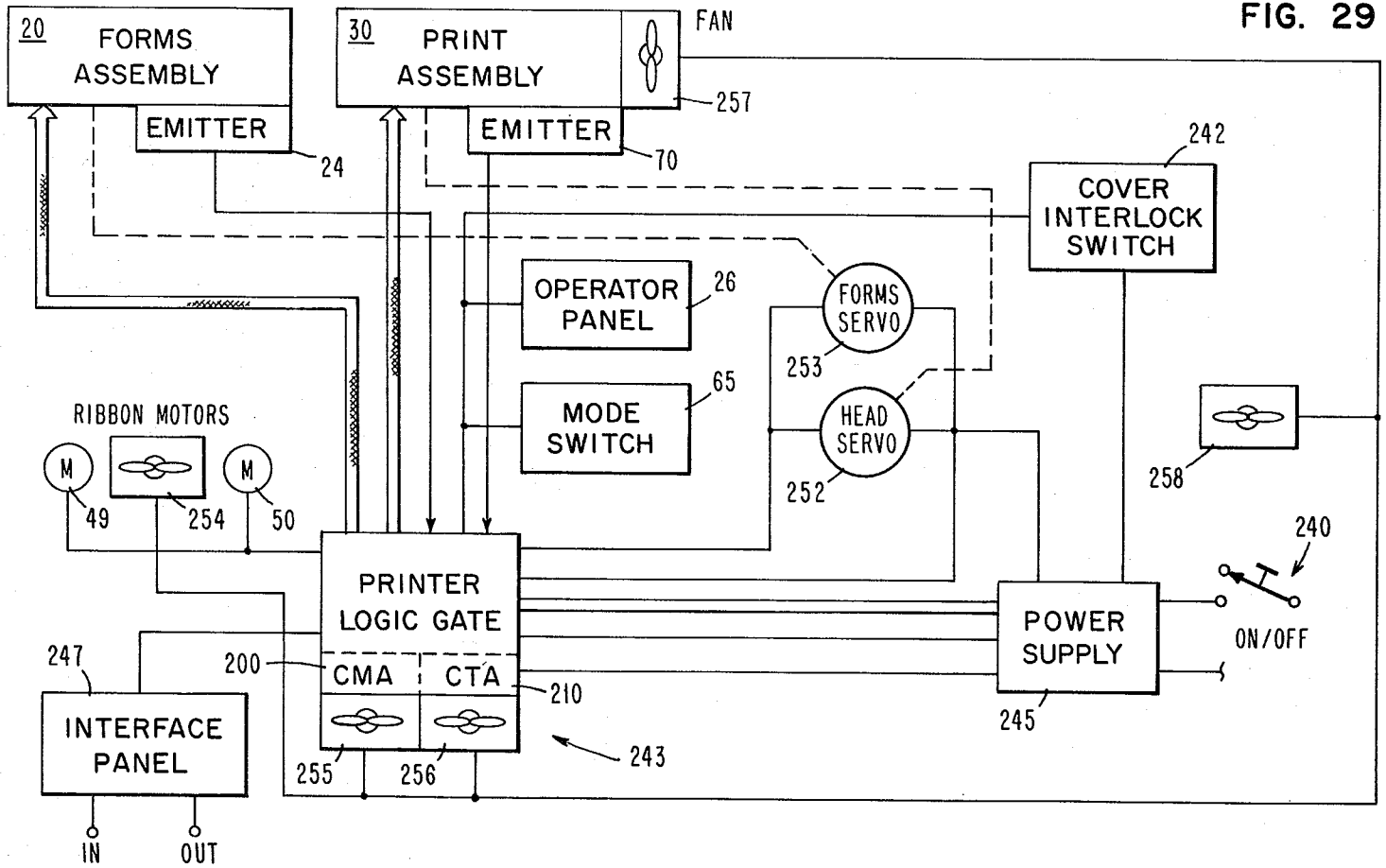

FIGS. **27*a* and 27*b* when joined as shown in FIG. 28** illustrate the physical relationships of the print wires relative to a form to be printed and also show character formation;

FIG. 29 is a block diagram of various electronics used in the printer subsystem.

DESCRIPTION OF PRINTER SUBSYSTEM AND PRINTER MECHANISMS

In order to best illustrate the utility of the present invention, it is described in conjunction with a high speed matrix printer, typically capable of printing in a high range of lines per minute on continuous forms.

Figure 1:
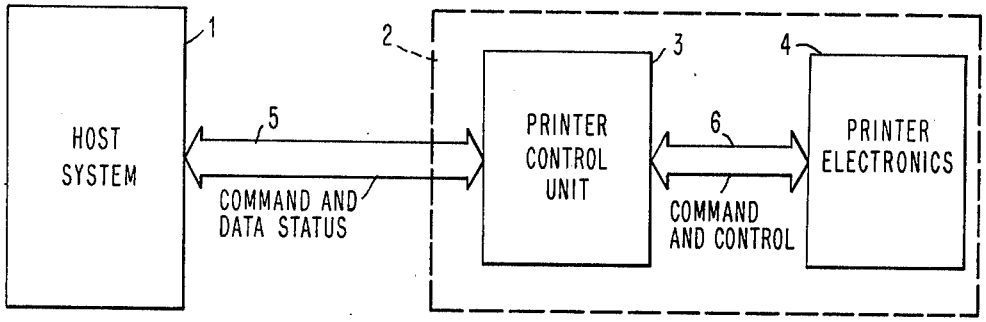
FIG. 1 is a simplified system diagram of a printer subsystem in which the invention is incorporated.

FIG. 1 illustrates a representative system configuration including a host system 1 and the printer subsystem 2 which includes a printer control unit 3 and printer electronics 4. Command and data signals are provided from the host system by way of interface 5, and command and control signals are provided from printer control unit 3 to the printer electronics 4 by way of bus 6. Status signals are supplied by printer control unit 3 to host system 1 by way of interface 5. Typically, the host system 1 generates information including commands and data, and monitors status. Printer control unit 3 receives the commands and data, decodes the commands, checks for errors and generates status information, controls printing and spacing, and conducts printer diagnostics. Printer electronics 4 executes decoded control unit commands, monitors all printer operations, activates print wires, drives motors, senses printer emitters, and controls operator panel lights and switching circuitry. It controls the tractor/platen mechanism, the ribbon drive, the print head (i.e., actuator group) carrier, the operator panel, and the printer sensors.

The elements of the system, such as the printer control unit and printer electronics, incorporate one or more microprocessors or microcomputers to analyze commands and data and to control operations.

Figure 2:
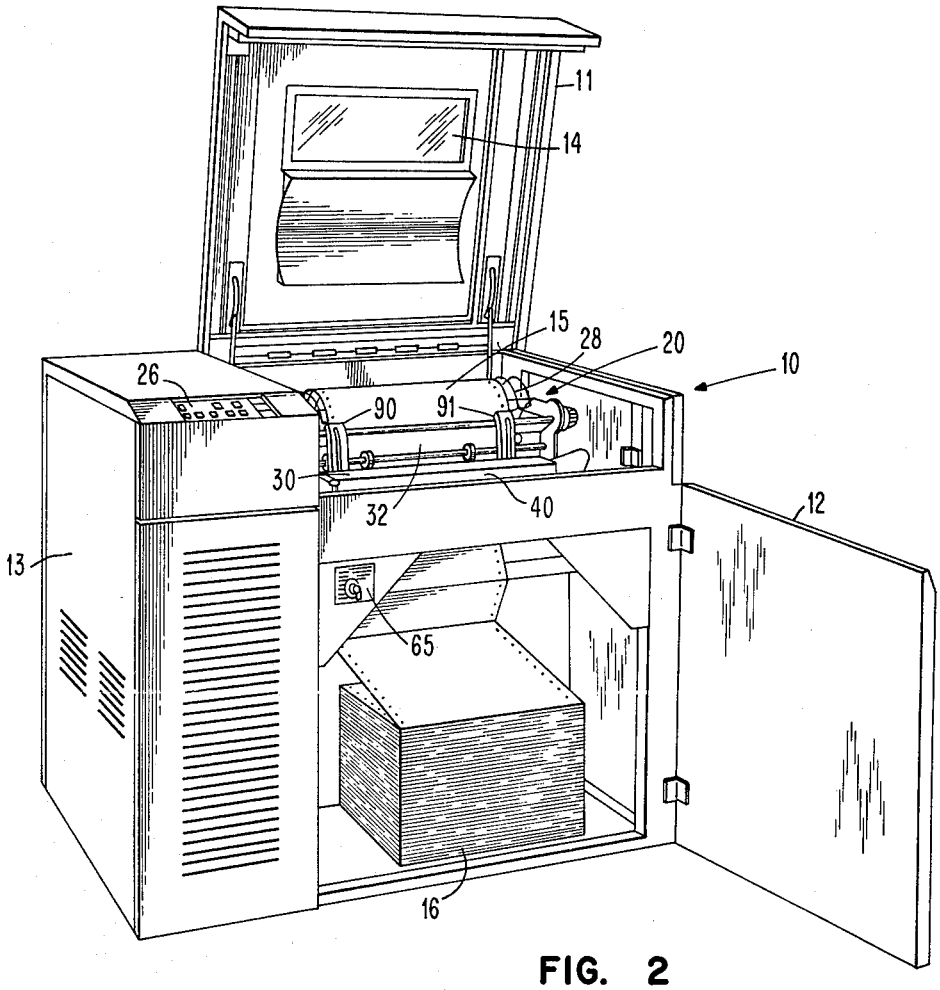
FIG. 2 illustrates the printer console and a number of printer components as well as forms feeding.
Figure 3:
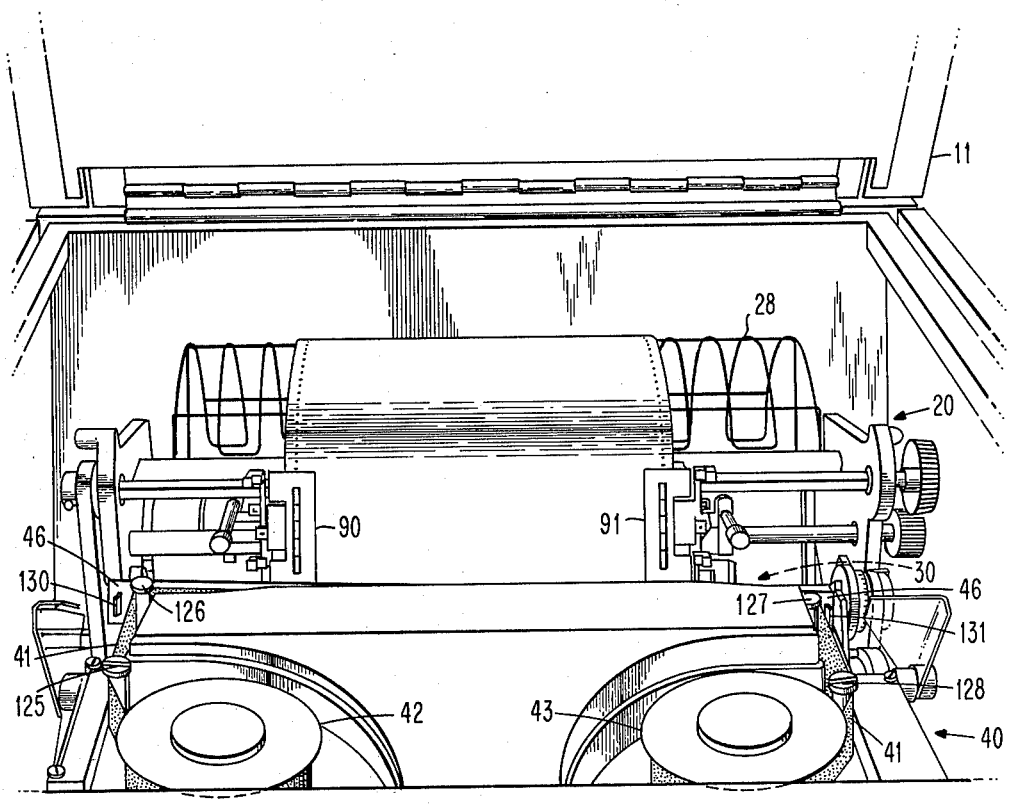
FIG. 3 is a frontal view of the printer.

FIGS. 2 and 3 illustrate various components of the printer all of which are housed in the console 10. Various access panels or covers such as those designated 11, 12, and 13 are provided. Top cover 11 has a window 14 that enables an operator to observe forms movement during operation of the printer and when the top cover is closed. Forms (documents) 15 are provided from a stack 16 and can be fed in one embodiment upwardly or downwardly as viewed in FIGS. 2 and 3 by means of a forms feed assembly 20 which includes one or more sets of forms tractors such as the upper set comprising tractors 90 and 91. A forms guide 28 guides the forms after printing to a takeup stack, not shown, but positioned below the printing mechanism and to the rear of the printer console. The printer incorporates a print assembly 30 that is positioned generally in a horizontal relationship with respect to forms 15 at a print station 32. Print assembly 30 is more clearly visible in other views. This is also true of the printer ribbon drive assembly 40 which is located in closer proximity to the front of the printer. Printer control unit 3 and its associated microprocessors are generally located behind the side cover 13.

A ribbon 41 is provided on one of the spools 42 or 43, which are disposable. Each box of ribbons would preferably contain a disposable ribbon shield 46 that fits between print assembly 30 and forms 15 to keep ribbon 41 in proper alignment and to minimize ink smudging on forms 15. Two motors drive ribbon 41 back and forth between spools 42 and 43. The printer control unit detects ribbon jams and end-of-ribbon (EOR) conditions. A ribbon jam turns on an error indicator and stops printing. An EOR condition reverses the ribbon drive direction.

The printer includes an operator panel 26 (shown and described in greater detail in the Boynton et al and other cross-referenced applications) that consists of several operator control keys, two indicator lights, a power on/off switch, and an operator panel display.

A 16-position mode switch 65 (shown and described in the Boynton, et al and other cross-referenced applications) has an online position that permits printing to be controlled by the using system. All other positions are offline and do not allow printing to be initiated from the using system.

OVERVIEW OF PRINTER MECHANISMS

FIGS. 4–9 show details of construction of the forms feed assembly 20, print assembly 30, and ribbon drive assembly 40.

Forms feed assembly 20 has end plates (side castings) 21 and 22 which support the various forms feed mechanisms including a drive motor 23 to drive tractors 90–93 through timing belt 109 and a platen 29 located behind the forms and against which the print wires 33 are actuated during printing. Motor 23 has a forms feed emitter assembly 24 and there is a separate end of forms and jam detector emitter 25.

The print assembly 30 includes a base casting 75 supporting various mechanisms including print motor 76, shown in phantom in order that other elements may be seen more easily, and connected to drive a print head carrier 31 with actuator block assembly 77 in a reciprocal fashion horizontally to effect printing on an inserted form. The print assembly also drives a print emitter 70 having an emitter glass 71 and an optical sensor assembly 72.

The ribbon drive assembly 40 includes a support casting 44, a cover 115, and drive motors 49 and 50.

FORMS FEED ASSEMBLY

In order to load paper in the printer the forms feed assembly 20 pivots away from the base casting 75 at pivot points 80 (80') and 81 (81') to allow access to thread the paper into position. Latches 83 and 84 are raised by the operator so that extremities **83*a* and 84*a* disengage eccentric pins 85 and 86 on the forms feed tractor. The forms feed tractor then pivots away from the operator as viewed in FIGS. 2–4 and to the right as viewed in FIG. 6. This allows access to the tractors 90–93 so that the operator may load paper. The forms feed assembly is then reclosed and relatched by latches 83 and 84 for normal machine operation. During the time that the forms feed assembly is pivoted back for service, a switch 94 prevents machine operation. This switch is actuated by a tang 95** on the forms feed assembly when it is closed.

Figure 6:
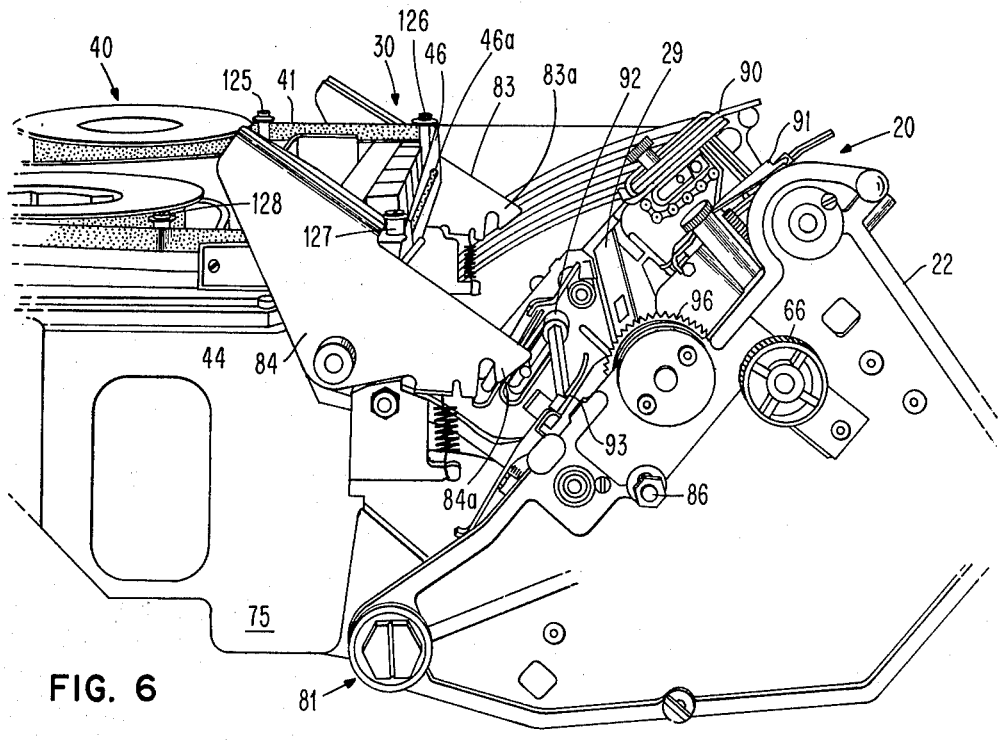
FIG. 6 is a right end perspective view of the forms feed assembly, print assembly, and ribbon drive assembly.
Figures 7, 8, 9:
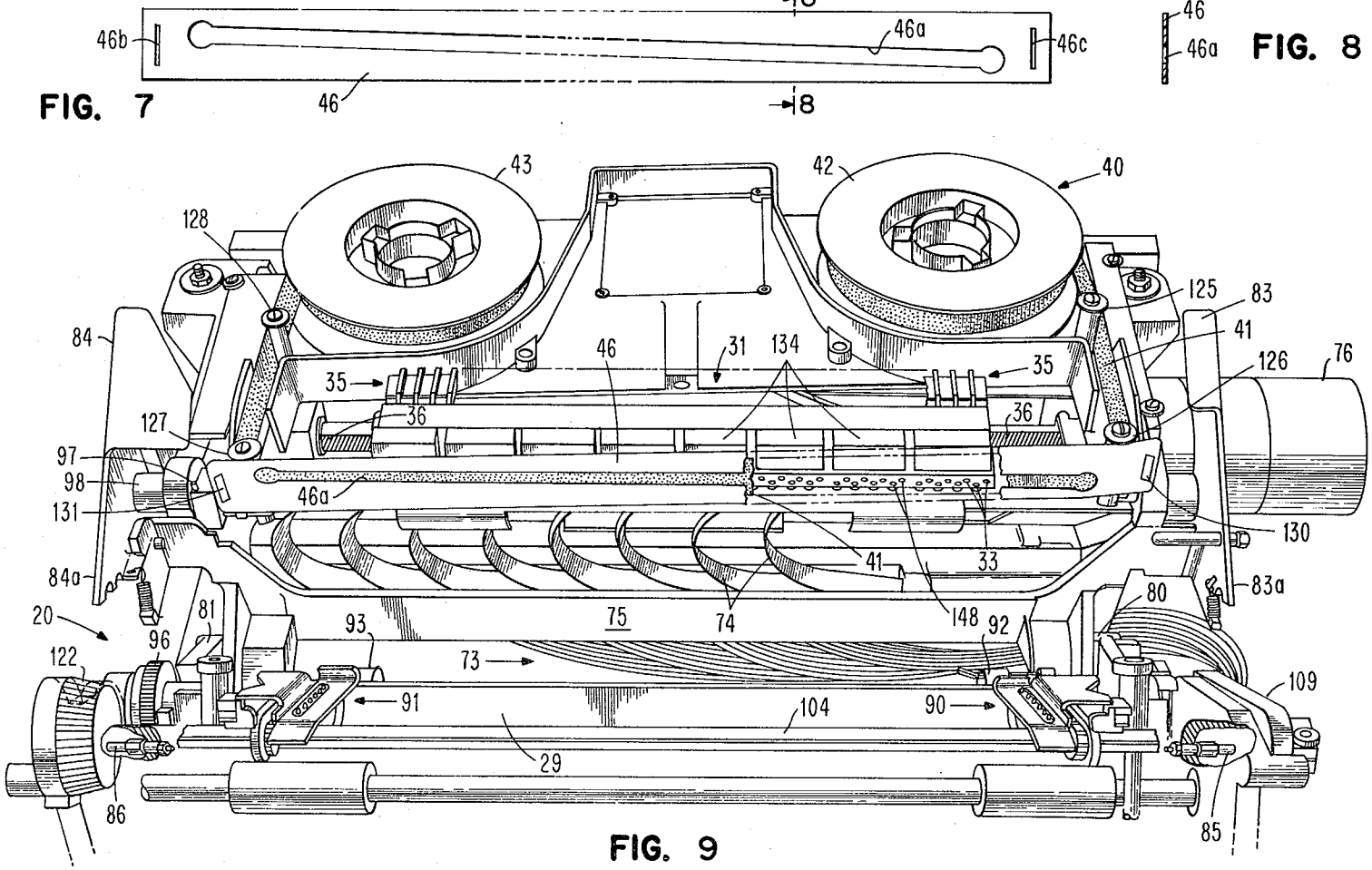
FIGS. 7 and 8 illustrate a ribbon shield utilized in the printer.
FIG. 9 is an overhead view of the printer slightly from the rear of the unit showing the forms feed assembly open.

Referring to FIGS. 6 and 9, the forms feed assembly includes means for adjusting for forms thickness. As mentioned, the entire forms feed assembly pivots back from the rest of the printer about pivot points 80 and 81. In the closed position the forms feed assembly is in such a position that a spiral cam 96 engages a pin 97 on the main carrier shaft 98 of the print assembly 30. Adjustment of the spiral cam and knob assembly 96 is such that it rotates the main carrier shaft 98. Assembly 96 is retained in position by a spring loaded detent assembly. This has a spring loaded pin which engages notches in the knob so that it is held in the position set by the operator. Associated with shaft 98 are eccentrics such as portion **98*a* on the left end of shaft 99 with tenon 100 onto which latch 83 is mounted. Rotation of shaft 98 thus moves latches 83 and 84 which changes the distance between the ends of print wires 33 and platen 29**. This adjustment enables the printer to accommodate forms of various thicknesses. The printer can handle forms from one part to six parts thickness.

The paper feeding is accomplished by the four sets of tractors 90–93 two above the print line and two below the print line. The individual tractors include drive chains to which pins are attached at the proper distance to engage the holes in the form. As an example, tractor 90 has drive chain 101 with pins 102. Chain 101 is driven by a sprocket 103 attached to a shaft 104 which also drives the sprocket and chains for tractor 91. Tractors 92 and 93 are driven from shaft 105. Because the tractors are above and below the print line, the printer is able to move the paper in either direction. The normal direction of forms drive is upwardly in FIGS. 2, 3, 4 and 6. However, it is possible to move the paper downwardly, as well.

Rotation of shafts 104 and 105 and forms feeding is accomplished by appropriate drive of motor 23 in the proper direction which in turn drives pulleys 106 and 107 (to which shafts 104 and 105 are connected) from motor pulley 108 by means of drive-timing belt 109. Cover 110 covers belt 109 and pulleys 106–108 during rotation. The forms feed emitter assembly 24 includes an emitter wheel 47 with marks to indicate rotation and a light emitting diode assembly 48 that serve to indicate extent of rotation of motor 23 in either direction and, as a consequence, the extent of movement of the forms as they are driven by motor 23.

The capability of the printer to feed paper in both directions offers some advantages. For example, in order to improve print visibility at the time the Stop button is pushed by the operator, the paper may be moved up one or two inches above where it normally resides so that it can be easily read and can be easily adjusted for registration. When the Start key is depressed, the paper is returned to its normal printing position back out of view of the operator. The printer may also be used in those applications where plotting is a requirement. In this case a plot may be generated by calculating one point at a time and moving the paper up and down much like a plotter rather than calculating the entire curve and printing it out from top to bottom in a raster mode.

End of forms and jam detection is accomplished in this assembly by a sprocket 112 just above the lower left tractor. The teeth in this sprocket protrude through a slot 113*a* in the flip cover 113. This sprocket is not driven by any mechanism but simply is supported by a bearing. The sprocket engages the feed holes in the paper as it is pulled past by the tractor assemblies. On the other end of the shaft 114 from the sprocket is a small optical emitter disc 115. The marks in this disc are sensed by an LED phototransistor assembly 116 and supplied to the electronics of the subsystem. The electronics verifies that marks have passed the phototransistor at some preselected frequency when the paper is being fed. If the mark is not sensed during that time, the machine is shut down as either the end of forms has occurred or a paper jam has occurred.

The castings 88 and 89 supporting the tractors 90–93 are adjustable left or right in a coarse adjustment in order to adjust for the paper size used in a particular application. After they are properly positioned they are locked in place on shaft 67 by locking screws such as locking screw 87.

All tractors are driven by the two shafts 104 and 105 from motor 23 as previously described. The motor adjusts in the side casting 21 in slots 120 in order to provide the correct tension for belt 109.

Besides the coarse adjustment, there is also a fine adjustment which is used to finally position in very small increments laterally the location of the printing on the forms. This is done by a threaded knob 66 which engages shaft 67 to which both tractor castings clamp. This shaft floats between side castings 21 and 22 laterally. The threads in knob 15 engage threads on the right end of shaft 67. The knob is held in a solid position by a fork 68. Therefore, knob 66 stays stationary and the threads driving through the shaft force shaft 67 laterally left or right, depending upon the direction in which knob 66 is rotated. Shaft 67 is always biased in one direction to take out play by a spring 69 on the left end of shaft. As the paper leaves the top of the tractors, it is guided up and toward the back of the machine and down by the wire guide 28.

In order to insure that the distance between the pins in the upper tractors is in correct relationship to the pins in the lower tractors an adjustment is performed. This adjustment is made by inserting a gauge or piece of paper in the tractor assembly which locates the bottom pins in the correct relationship to the top pins. This is done by loosening a clamp 121 on the end of shaft 104. Once this position is obtained, then clamp 121 is tightened and in effect phases the top set of tractors to the bottom set so that holes in the paper will engage both sets of tractors correctly. Forms may be moved through the tractor forms feed mechanism manually by rotating knob 122. This knob simply engages the top drive shaft 104 of the upper tractor set and through the timing belt 109 provides rotational action to the lower tractor set, as well.

PRINT ASSEMBLY

Figure 4:
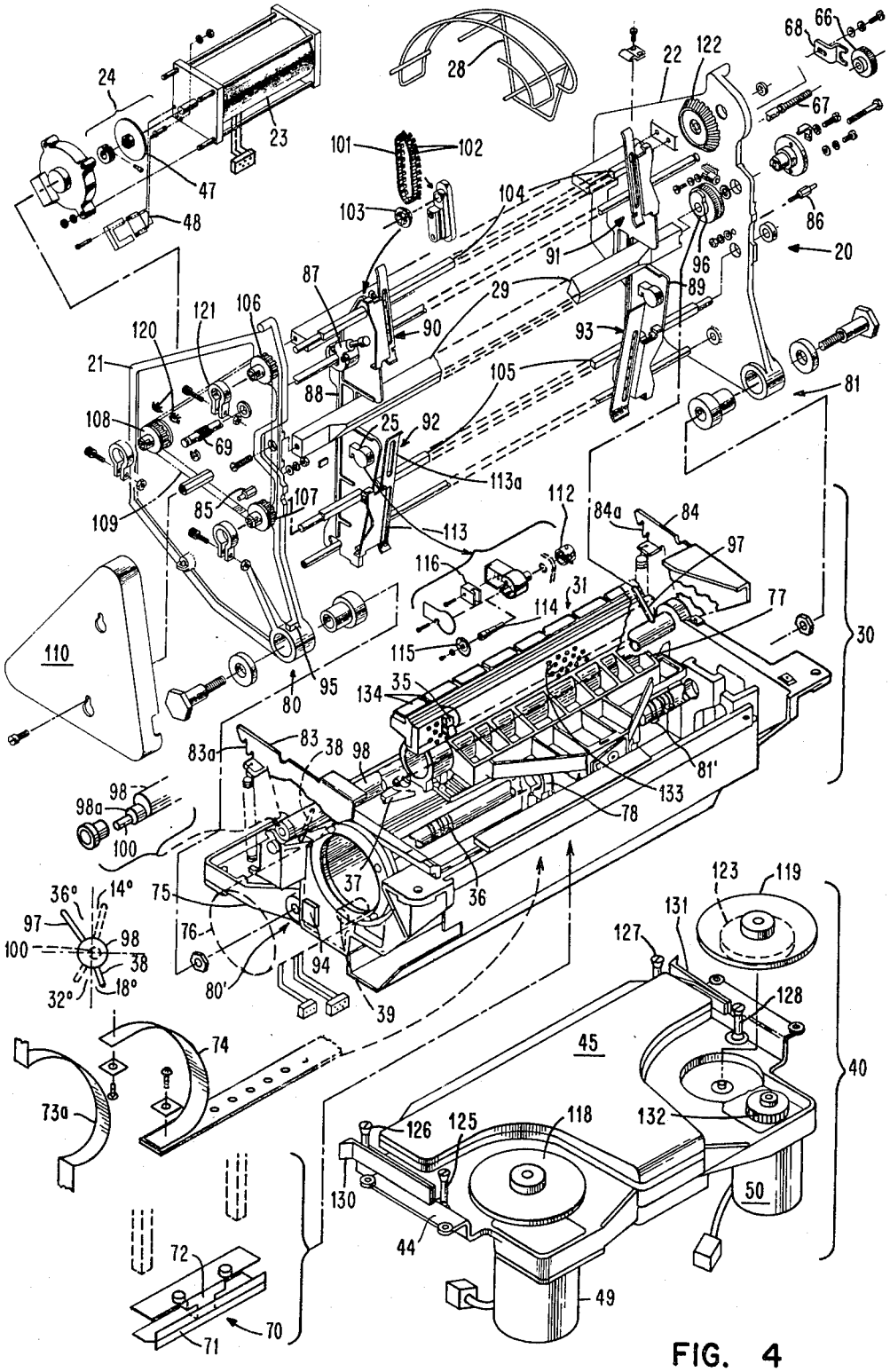
FIG. 4 is an exploded view of various printer assemblies including the forms feed assembly, the print assembly, and the ribbon drive assembly.
Figure 5:
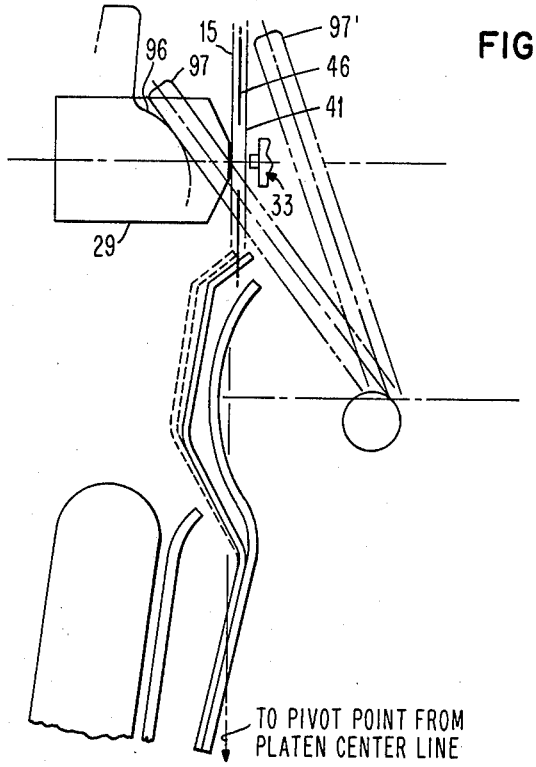
FIG. 5 is a diagram showing the relationship of various elements at the print line.

In FIGS. 4 and 9, a carrier 31 comprising an actuator block 77 and support 78 accommodate all the print heads with their wire actuators 35 and print wires 33. This assembly is structured to hold from 2 up to 8 or 9 print head groups of eight actuators each. Thus, a printer with eight print head groups, as shown in FIG. 4, has sixty-four print wire actuators and sixty-four associated print wires. Only two actuators 35 are shown positioned in place in FIG. 4. The other sixty-two actuators would be located in apertures 133 only a few of which are depicted. To insure long life of the print wires, lubricating assemblies 134 containing oil wicks are positioned in proximity to the print wires. The print wire actuators fire the wires to print dots to form characters. Carrier 31 is shuttled back and forth by a lead screw 36 driven by motor 76. Lead screw 36 drives the carrier back and forth through nuts which are attached to the carrier. When carrier 31 is located at the extreme left, as viewed in FIGS. 3 and 4 (to the right as viewed in FIG. 9), this is called the "home position". When the carrier is moved to the home position, a cam 37 attached to the carrier engages a pin 38, the pin being attached to the main carrier shaft 98. If the machine has not been printing for some period of time, in the neighborhood of a few seconds, the printer control unit signals the carrier to move all the way to the left, in which case cam 37 engages pin 38 to rotate the main carrier shaft 98 approximately 15 degrees. On each end of the shaft are the eccentrically located tenons, such as tenon 100, previously described. These tenons engage the latches 83 and 84 so that the distance between the print assembly and the forms feed assembly is controlled by the latches. As shaft 98 rotates, the eccentrics associated with latches 83 and 84 separate the forms feed assembly from the print assembly.

The current necessary to fire the print actuators is carried to the actuators via the cable assemblies 73, FIG. 6, one for each group of eight actuators. The cabling, such as cable 73*a*, FIG. 4, is set in the machine in a semicircular loop so that as carrier 31 reciprocates it allows the cable to roll about a radius and, therefore, not put excessive stress on the cable wires. This loop in the cable is formed and held in shape by a steel backing strap 74. In this case there is one cable assembly for each group of eight actuators or a maximum of eight cable backing strap groups on each machine.

RIBBON DRIVE ASSEMBLY

The ribbon drive assembly 40 for the printer is shown in FIGS. 3, 4, and 9 primarily. Spools 42 and 43 which contain the ribbon can be seen on either side of the machine near the front, FIG. 3. These spools typically contain 150 yards of nylon ribbon that is one and a half inches wide. Gear flanges 118 and 119, FIG. 8, support ribbon spools 42 and 43, respectively. Drive for spool 43, as an example, is from motor 50, pinion gear 132 to a matching gear 119*a* formed on the underneath side of gear flange 119 then to spool 43. In one direction of feed, the ribbon path is from the left-hand spool 42 past posts 125 and 126, FIGS. 3, 4, and 9, across the front of the ribbon drive assembly between the print heads 34 and forms 15, then past posts 127 and 128 back to the right-hand ribbon spool 43. The ribbon shield is generally located between posts 126 and 127 and is mounted on the two attachment spring members 130 and 131.

RIBBON SHIELD

FIG. 7 illustrates a ribbon shield 46 that is particularly useful in the printer of FIGS. 3, 4, and 9. FIG. 8 is a cross-sectional view along the lines 8—8 in FIG. 7. Shield 46 has an elongated aperture 46*a* extending almost its entire length. The aperture enables the print wires 33 to press against the ribbon in the printer through the shield in order to print on forms 15. Shield 46 has slits 46*b* and 46*c* at opposite extremities to permit easy mounting in the printer on spring members 130 and 131 of the ribbon drive assembly, FIGS. 3 and 6. Shield 46 and ribbon 41 are illustrated slightly on the bias in FIGS. 3 and 6 which is their more normal relationship in the printer. The ribbon drive assembly 40 is also positioned on a slight bias relative to horizontal to establish the bias of shield 46 and ribbon 41. In this condition aperture 46*a* assumes a horizontal relationship with respect to the print wires 33 and form 15.

ACTUATOR BLOCK, GUIDE, AND ACTUATORS

Figure 10:
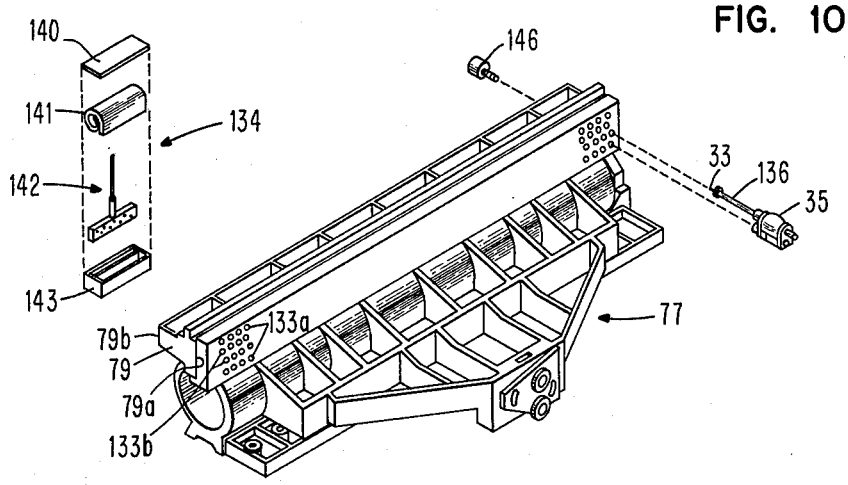
FIG. 10 is an isometric view of the print wire actuator block, guide, and support elements.

Enlarged views of the actuator block 77, guide 79, actuators 35, lubricating assemblies 134, and various related mechanisms are shown in FIGS. 10–22. Other versions of the actuator block assembly for 2, 4, 6 and 8 print heads are shown in FIGS. 23–26 and will be described shortly. Referring to FIG. 10, this better illustrates the arrangement of apertures 133 in actuator block 77. Apertures 133*a* are used to mount actuators 35 while apertures 133*b* allow passage of barrels 136 of actuators 35 through actuator block 77 and guide 79 up to the print line. A typical lubricating assembly 134 comprises a cover 140, felt element 141, wick assembly 142, and housing 143 that contains lubricating oil.

Figure 11:
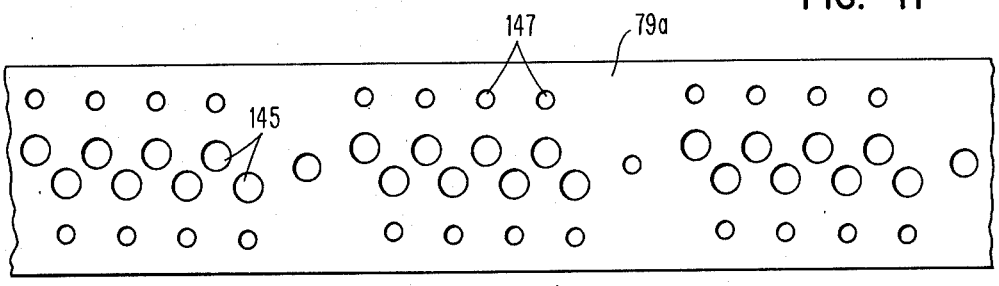
FIGS. 11 and 12 are different views of the guide shown in FIG. 10.
Figure 12:
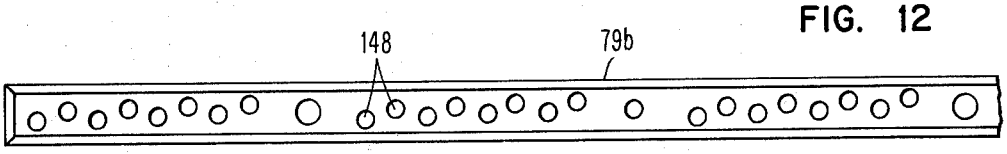

FIG. 11 illustrates a portion of face 79*a* of guide 79 while FIG. 12 illustrates a portion of face 79*b* of guide 79. Barrels 136 of actuators 35 pass through apertures 145 on face 79*a* of guide 79 and are retained by bolts such as bolt 146 passing through apertures 147 from the opposite side of guide 79. Individual actuator barrels 136 and print wires 33 project through apertures 148, FIGS. 9 and 12.

Figure 13:
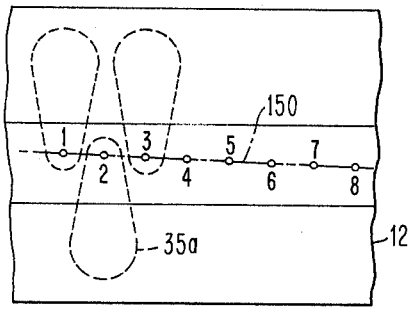
FIGS. 13–18 illustrate alternative mounting arrangements for the print wire actuators.
Figure 14:
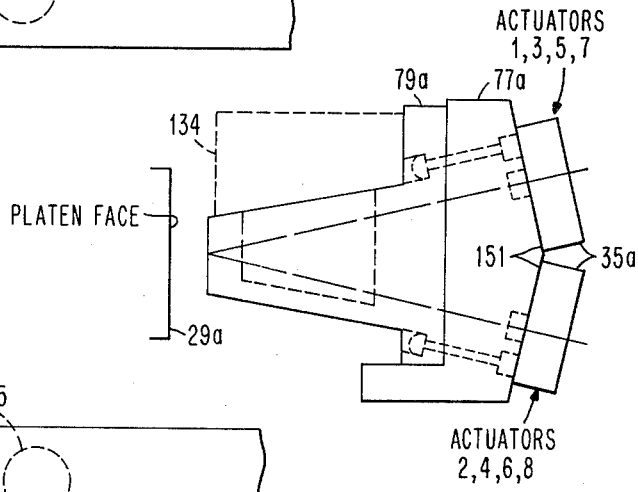
Figure 15:
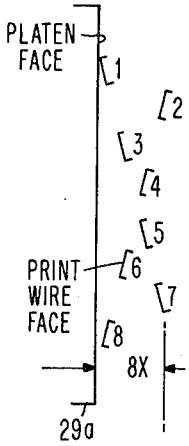
Figure 16:
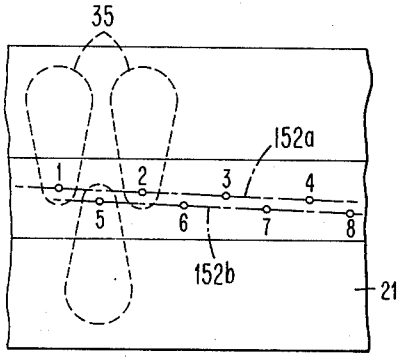
Figure 17:
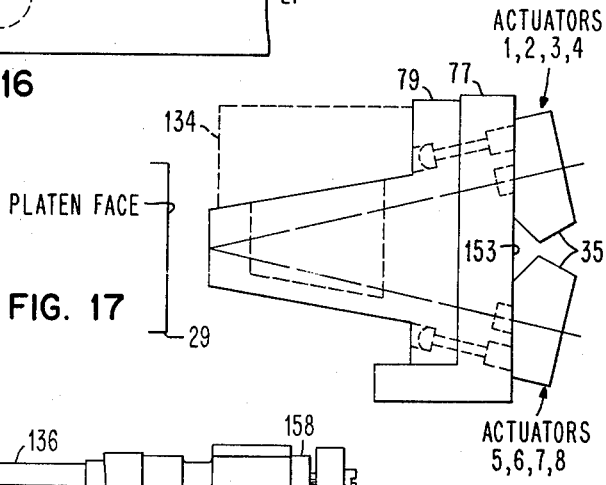
Figure 18:
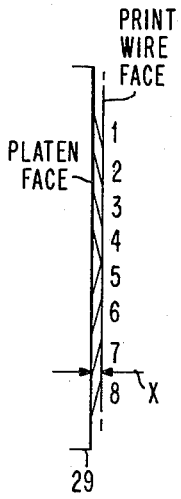

FIGS. 13–18 illustrate several arrangements which permit mounting of a greater multiplicity of actuators in a given amount of space through actuator block 77 and guide 79. FIGS. 13–15 illustrate one possible mounting arrangement for the actuators while FIGS. 16–18 illustrate the actual mounting arrangement previously described in conjunction with FIGS. 4, 9, and 10–12.

In FIGS. 13–15 which represent an alternative mounting arrangement, print actuators 35*a* and print wires 35 for one print head set of 8 (1–8) are arranged on a straight slope 150. This slope, combined with actuator block 77*a* having a double angle configuration at 151, FIG. 14, results in a staggered print wire face-to-platen condition, FIG. 15. This print wire face-to-platen distance, shown as *8x*, is critical to both the stroke and flight time of the print wires.

The preferred arrangement, FIGS. 16–18, has a number of attributes, including improved functioning, increased coil clearance, and ease of manufacture. In this arrangement, print wires 35 are positioned in a set 1–8 and are mounted in two offset sloped subsets 152*a* and 152*b* forming a sloped serrated pattern. (See also FIGS. 11 and 12.) Subset 151*a* includes print wires 1–4 of the set while subset 152*b* includes print wires 5–8. This, combined with a straight surface 153 on actuator block 77 and angled actuators 35, FIG. 17, represent an inline print wire face-to-platen condition as in FIG. 18. The print wire face-to-platen distance, shown as "x", is at a minimum. This permits a higher printing rate and prevents wire breakage. The offset sloped print wire sets gives a greater clearance between wire positions which allows a larger actuator coil to be used.

Use of a straight surface 153 instead of the double angle 151 facilitates manufacturing of the actuator block and thereby reduces cost. However, brackets 155 are still cut at an angle such as shown in FIG. 20.

The angular relationships of the print actuators 35*a* with respect to the platen faces in FIG. 14 and print actuators 35 with respect to the platen face in FIG. 17 are somewhat larger than would be encountered in an actual implementation but they are shown this way to make the relationships easier to see. In contrast, an actual angular relationship might be smaller such as the 4°30′ angle front face on bracket 155 of actuator 35 in FIG. 20.

FIGS. 19–22 illustrate a preferred form of actuator 35. This actuator is based on the principles of operation described and claimed in U.S. Pat. application Ser. No. 043,183, filed May 29, 1979, having R. W. Kulterman and J. E. Lisinski as inventors and entitled "Springless Print Head Actuator". This application is assigned to the same assignee as the present application. In the Kulterman et al actuator, a print wire is provided having an armature which is retained in home position by a permanent magnet. When printing of a dot is required, an electromagnet is energized which overcomes the magnetic forces of the permanent magnet and propels the print wire toward the paper.

Figure 19:
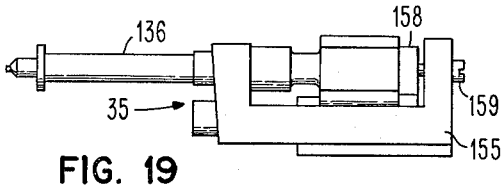
FIGS. 19–22 illustrate a print wire actuator used in conjunction with the print wire actuator block assembly.
Figure 20:
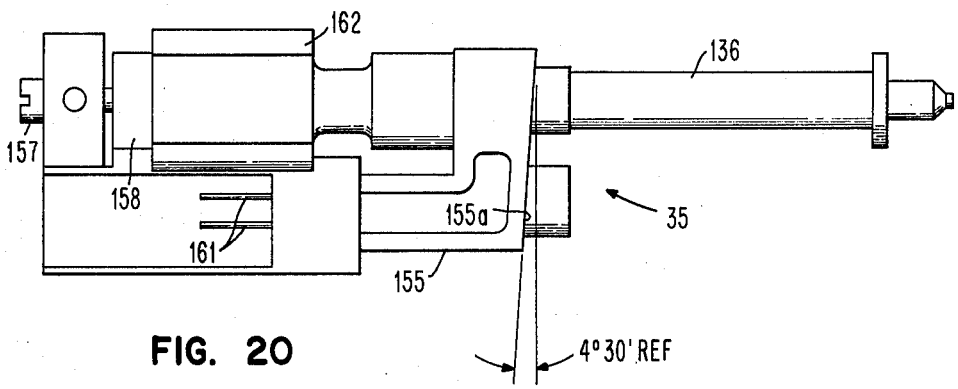
Figure 22:
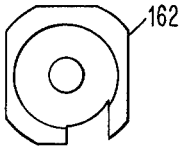
Figure 21:
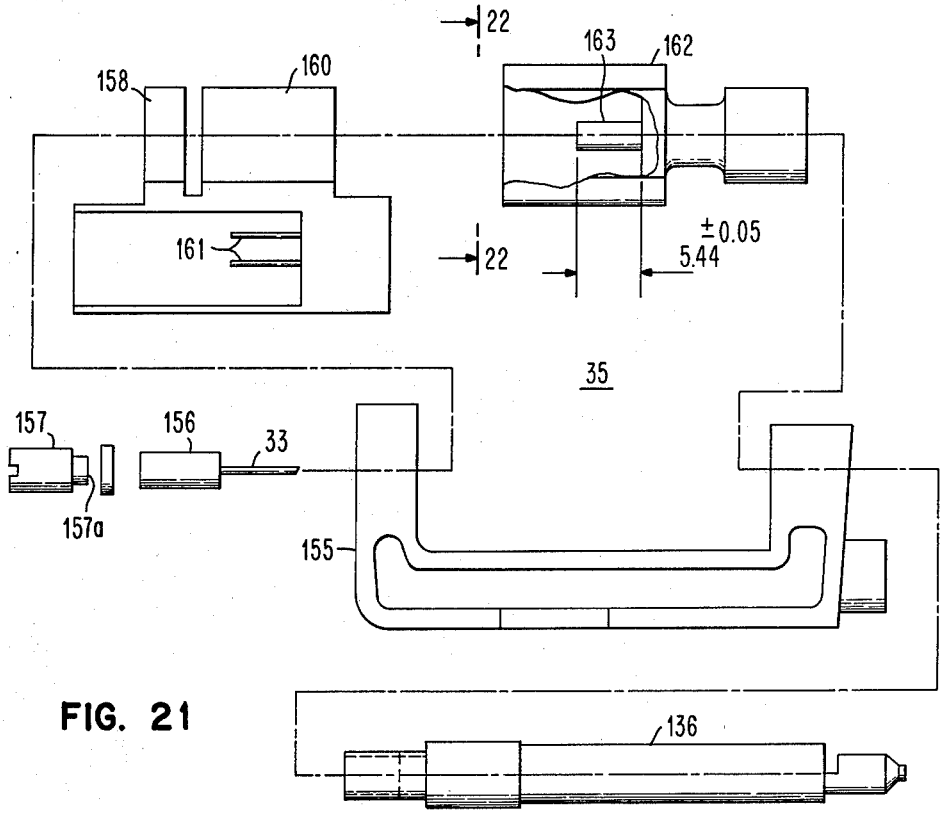
Figure 23:
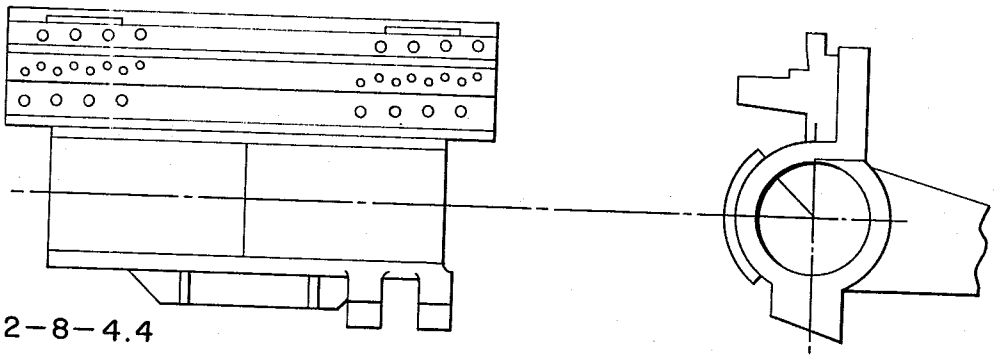
FIGS. 23–26 illustrate the actuator block assemblies for printer units with two, four, six, and eight print heads, respectively.
Figure 24:
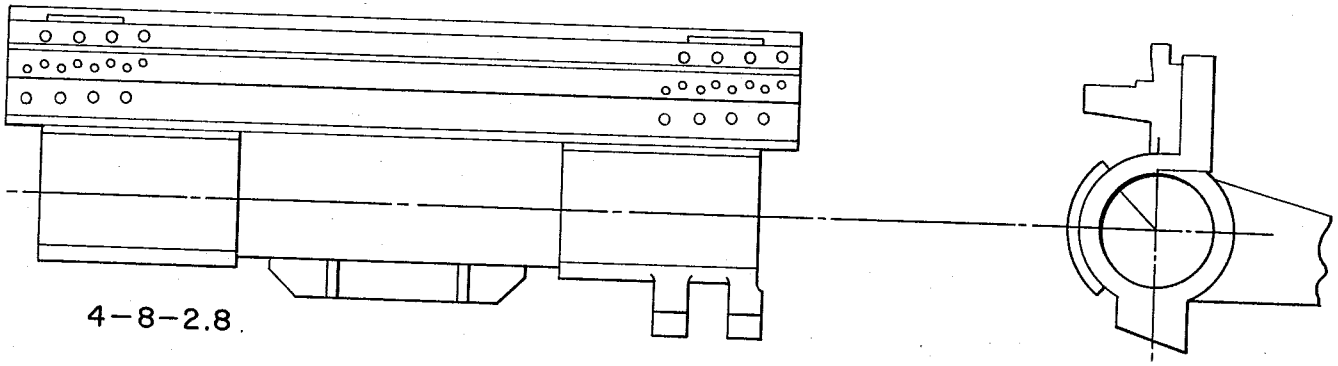
Figure 25:
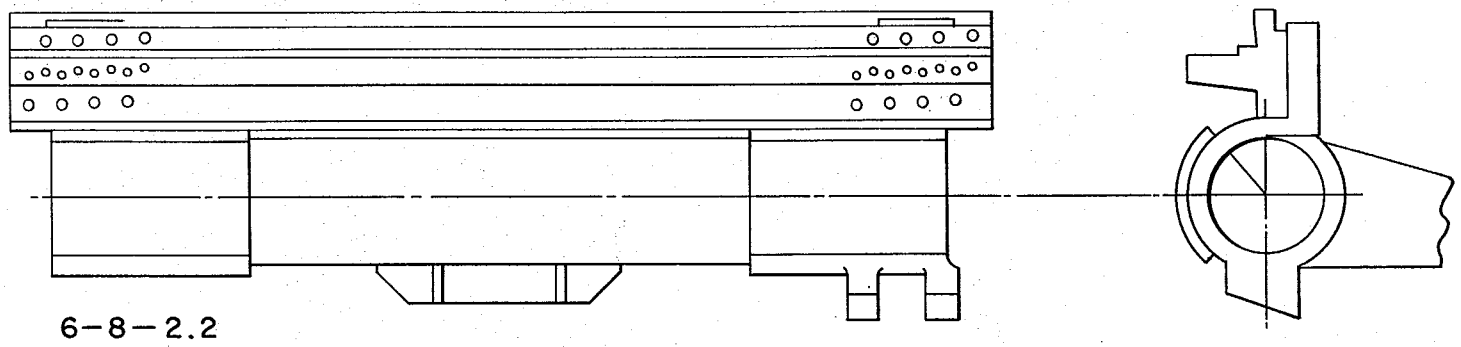
Figure 26:
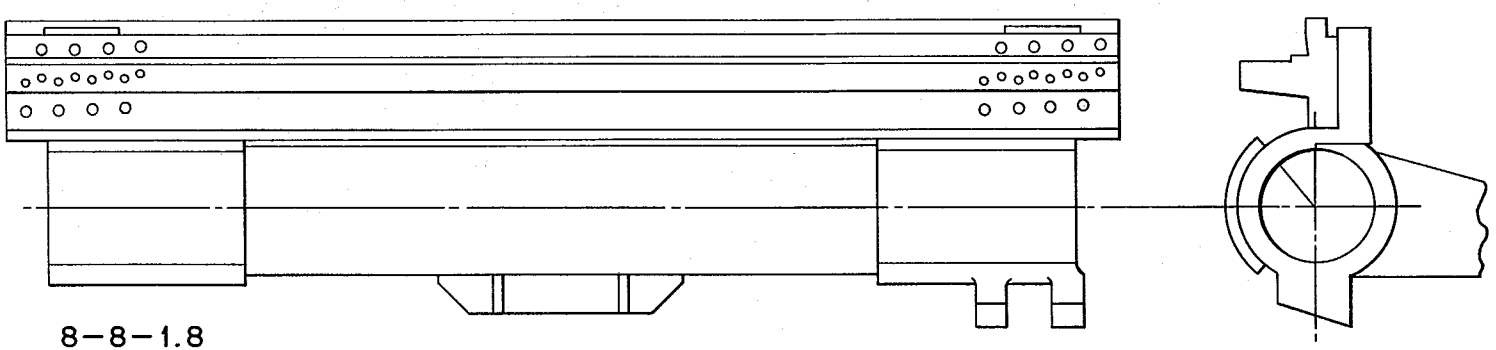

FIG. 19 illustrates one side elevation of the actuator, while FIG. 20 illustrates the opposite side elevation. The actuator comprises a number of elements arranged in a generally concentric manner on bracket 155. It is noted that FIG. 20 is somewhat enlarged relative to FIG. 19. Reference is also made to FIGS. 21 and 22 for details of the individual components of the actuator. Also, it is noted that some slight structural differences appear between the actuator shown in FIGS. 19–22 and those illustrated in FIGS. 13–18, the actuators in FIGS. 13–18 being more diagrammatically illustrated. The actuator includes a barrel 136 for supporting print wire 33 in proper relationship for printing when mounted in actuator block 77 and guide 79. Attached to the leftmost end of print wire 33 as viewed in FIG. 21 is an armature 156 which is arranged against a stop portion 157*a* of an adjustment screw 157 by forces exerted from a permanent magnet 158. A lock nut 159, FIG. 19, retains adjustment screw 157 in proper position. Thus, when not active, armature 156 and print wire 33 abut against stop 157*a*. When it is desired to actuate print wire 33, electromagnet 160 is rapidly impulsed from an external source by way of connectors 161. Energization of coil 160 overcomes the magnetic flux forces of permanent magnet 158 moving armature 156 and print wire 33 to the right as viewed in FIG. 21 thus causing the rightmost end of print wire 33 which is in proximity to the forms, to print a dot on the forms. A bobbin housing 162 is made of metallic substances to provide a shielding effect with respect to electromagnet 160. It is found that this has been beneficial when numerous print actuators are mounted in position on actuator block 77 and guide 79 since it prevents stray impulses from reacting from one actuator to another nearby actuator. This has proven to be extremely advantageous when multiple print actuators are provided as in the present printer. A core element 163 provides a forward stop location for armature 156 in readiness for restoration by permanent magnet 158 against stop 157*a* as soon as current is removed from coil 162.

FIG. 22 is an end elevation of housing 162 along the lines 22–22 in FIG. 21.

ACTUATOR BLOCK ASSEMBLIES FOR DIFFERENT PRINTER UNITS

FIGS. 23–26, respectively, illustrate the actuator block assemblies that are utilized for printer units having two, four, six, and eight print heads each actuator block assembly comprising an actuator block and actuator guide. These are combined frontal and end elevations of the respective actuator block assemblies. The actuator block assembly for the eight print head unit in FIG. 26 has previously been described, especially in conjunction with FIGS. 10–12.

Each of the FIGS. 23–26 carries a legend indicative of useful information concerning the respective actuator block assembly. As an example, referring to FIG. 23, the actuator block assembly for the "two head" printer unit has the legend "2–8–4.4". This simply represents that this actuator block assembly has two print heads with eight print wires in each print head and that the first wire in one print head is located 4.4 inches from the first print wire in the other print head. The assembly for "four print heads", FIG. 24, has the legend "4–8–2.8". This indicates that this is a four print head assembly, each print head having eight print wires and that the first print wire in each print head is 2.8 inches distance from the first print wire in the next succeeding print head. The same principles apply to the legends for the actuator block assemblies illustrated in FIGS. 25 and 26.

Naturally, the greater the number of print heads the greater the throughput of the printer unit. Also, the greater the number of print heads, the less movement is required for the print head carrier 31 and the actuator block assembly.

RELATIONSHIPS OF PRINT WIRES, CHARACTER LOCATIONS AND EMITTERS

Characters that are printed are formed by printing dots on the paper. These dots are printed by wires that are mounted in groups of eight on a carrier 31 that moves back and forth adjacent to the print line. Printing is bidirectional with complete lines of print formed right-to-left and left-to-right. See FIGS. 27*a* and 27*b*.

Figure 27A:
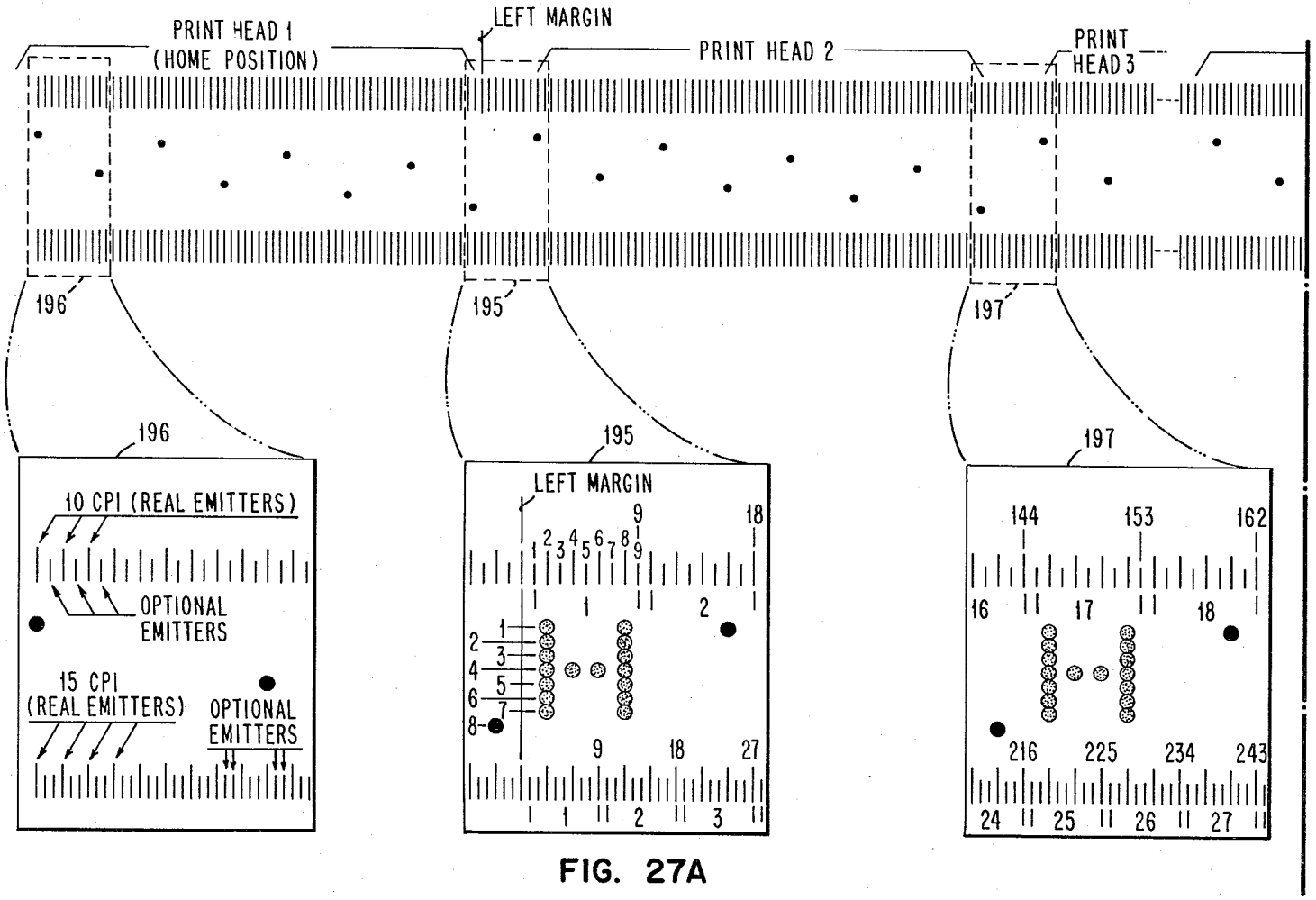

A character is formed in a space that is eight dots high by nine dots wide. As shown in FIG. 27*a*, two of the nine horizontal dot columns (1 and 9) are for spacing between characters. Any one wire can print a dot in four of the seven remaining horizontal dot positions (2 through 8). The printer can print 10 characters per inch or 15 characters per inch.

Most of the characters printed use the top seven wires in the group to print a character in a format (or matrix) that is seven dots high and seven dots wide. The eighth (bottom) wire is used for certain lower case characters, special characters, and underlining.

The number of print wire groups varies according to the printer model, and typically can be 2, 4, 6 or 8 groups. Printing speed increases with additional wire groups. There are, as an example, 16 character sets stored in the printer control unit. Any of these sets may be specified for use by the host system program.

Figure 27B:
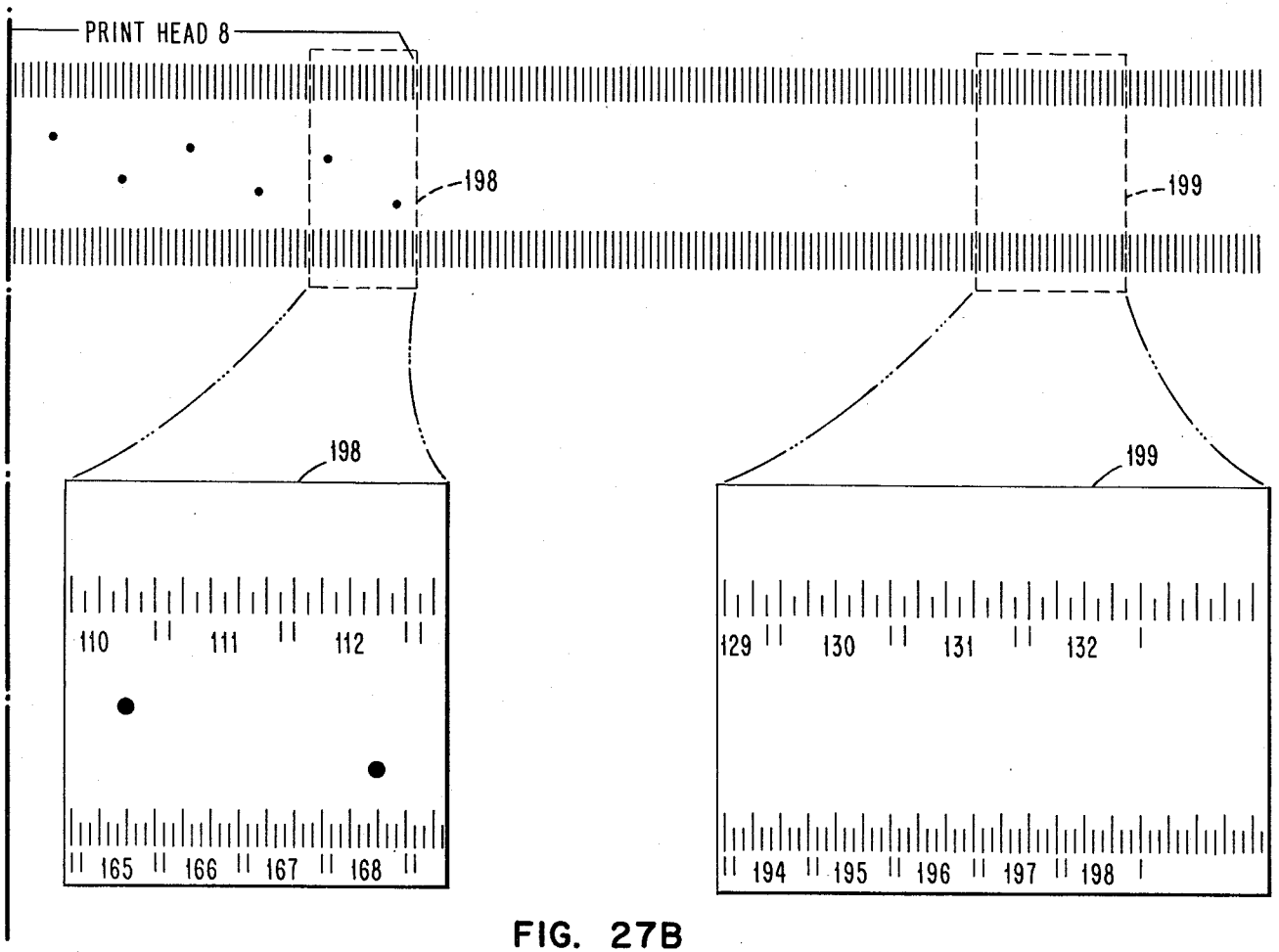

FIGS. 27*a* and 27*b*, when arranged as shown in FIG. 28, comprise a diagram showing the physical relationship of the print heads in the eight-head printer unit when in the "home" position relative to character locations on a form to be printed. In addition, the emitter relationships are shown.

In FIG. 27*a*, print head 1, comprising eight print wires, is normally to the left of the nominal left margin when in home position. Print head 2 lies to the right of the left margin when the print assembly is in home position and the other print heads up to eight, as an example, are physically located at successively further positions to the right in relation to the form. The print wires are arranged in a sloped serrated pattern and alternate print wires are displaced two character positions apart horizontally and one dot location apart vertically. In order to print the character "H" as shown in inset 195, it is necessary that all of the print wires in print head 1 sweep past the "H" character location to effect printing of the individual dots. As each wire passes by and reaches the appropriate position for printing of its assigned dot locations in a vertical direction, it is fired. Thus, formation of characters takes place in a flowing or undulating fashion insofar as the printing of the dots is concerned. That is, an entire vertical column of dots as in the left-hand portion of the character "H" is not formed all at once but is formed in succession as the eight wires in print head 1 sweep past that column. This is true of the printing of all other character columns, as well. As a result of this, each print head is required to pass at least far enough so that all of the wires in that print head will be able to print both the first vertical column of dots in the first character required as well as the last column of dots in the last character to be printed in the group of character locations assigned to that print head.

Accordingly, print head 1, during printing movement carrier 31, prints all of the characters that normally would appear underneath print head 2 when the print heads are in their "home" position. The printing of dots associated with print head 2 takes place under the "home" position for print head 3 and so on.

Inset 196 illustrates the relationship of real and optional emitters, sometimes referred to as "false" emitters for both ten characters per inch (CPI) and fifteen characters per inch (CPI). During the printing of characters at ten characters per inch, real emitters are found as indicated. These are physical real emitters derived from the emitter glass 71 as the print assembly sweeps from left to right or right to left during printing. The same real emitters are used for printing at fifteen characters per inch. However, when printing is at ten characters per inch, one additional (optional) emitter is necessary between each successive pair of real emitters to form the individual characters while, if characters are printed at fifteen characters per inch, two additional (optional) emitters are required between each successive pair of real emitters to handle the printing of dots for those characters.

Inset 197, FIG. 27*a*, illustrates the character locations associated with the rightmost print wire of print head 2 and the leftmost print wire of print head 3. Print heads 4–7 are not shown since the relations essentially repeat those shown with respect to print heads 1–3. The rightmost wires of print head 8 are shown in Inset 198, FIG. 27*b*. In addition, Inset 199 shows that for ten characters per inch, 132 characters can be accommodated in a full print line while for fifteen characters per inch, 198 characters are accommodated.

PRINTER GENERAL BLOCK DIAGRAM

FIG. 29 illustrates various printer blocks of interest. A power supply 245 supplies the unit with all the power to drive and to control. The on/off switch 240 controls power supply 245 being on and off. From the power supply the cover interlock switch 242 enables and disables the 48-volt drive which controls much of the printer logic 243. Logic 243, once enabled, looks at operator panel 26 for information as to the operations to be performed. Mode switch 65 tells the logic which type of operation in testing procedures should be run. Print assembly 30 is controlled by the printer logic along with the forms assembly 20. Emitter devices 24 and 70 supply positional information to the printer logic. The printer logic also controls and talks with the interface panel 247 and passes information on the other parts of the printer. The ribbon motors 49 and 50 are controlled in an on/off fashion by printer logic 243 which accepts inputs from the ribbon assembly to determine when the end of ribbon has occurred. Head servo 252 is a control block that insures that the print head is in the proper position at the proper time for the actuators to fire. Forms servo 253 is a control block that moves the forms to desired locations. Fans 254≧258 are used to control temperature within the machine. As described in the Boynton, et al patent application, printer logic 243 includes two microprocessor adapter blocks 200 and 210. The first one included is the communications adapter CMA which accepts input and passes it to the second one which is the control adapter CTA that actually controls the printer.

While a preferred embodiment of the invention has been illustrated and described, it is to be understood that there is no intention to limit the invention to the precise constructions herein disclosed and the right is reserved to all changes and modifications coming within the scope of the invention as defined in the appended claims.

I claim:

1. Print wire and print wire actuator mounting apparatus for a printer unit, comprising:

a print station incorporating facilities operable during printing operations for feeding and printing on forms at said print station, the printing operations occurring on a line-by-line basis at a print line at said print station, said print station further comprising a ribbon arranged to move past said forms along said print line;

a plurality of print wires, each of said print wires being reciprocable from an inactive to an active state in a predetermined direction of movement into printing contact with said forms;

a corresponding plurality of print wire actuators respectively coupled to said print wires, each of said actuators comprising a number of actuating elements including mounting means generally physically located substantially concentric with or along an extension of the direction of movement of its respectively coupled print wire and each of said actuators having at least one mounting surface that is angled normal with respect to the direction of movement of its coupled print wire, said actuators being operable to selectively reciprocate said print wires in order to print information on said forms along said print line during printing operations; and an actuator block assembly, said actuator block assembly having a flat mounting surface positioned substantially normal to the direction of movement of said print wires, said actuator block assembly incorporating a guide member, and said print wires and print wire actuators being mounted on said actuator block assembly in at least one set comprising at least two subsets wherein each of said subsets comprises an equal portion of the print wires and actuators in a set, the actuators in one of said subsets being mounted on the flat mounting surface of said actuator block assembly with their angled mounting surfaces in one angular relationship and the actuators in the other of said subsets being mounted on the flat mounting surface of said actuator block with their angled mounting surfaces in an opposite angular relationship, the two subsets thereby being angled inwardly toward one another and through said guide member as they approach the print line, and said first and second subsets being located in said actuator block assembly so that the ends of the print wires in said first and second subsets are maintained in at least two parallel slanted arrays relative to one another and further that each print wire in one of said subsets is offset with respect to both the preceding and succeeding print wires of another of said subsets whereby said print wires and actuators assume an angled serrated relationship with respect to the print line when in an assembled condition, whereby the printing ends of all of said print wires are held in close proximity with respect to said print line and in precise registration relative thereto and whereby said print wires and print wire actuators may be spaced relatively far apart on said actuator block assembly for ease in servicing.

2. The apparatus of claim 1, further comprising:

support means integrally incorporated in said actuator block assembly;

drive means including a drive motor and interconnected with said support means to drive said actuator block assembly in a reciprocating fashion along said print line during printing operations.

3. The apparatus of claim 2, further comprising:

lubrication means mounted on said guide member for lubricating print wires mounted in said actuator block assembly, said lubricating means comprising for each set of print wires and actuators a relatively wide housing containing lubricating oil and a single felt element and a single wick assembly in said housing, said felt element and said wick assembly extending across and in contact with all print wires in a set to provide lubrication to all of said print wires concurrently.

* * * * *